United States Patent [19]

How

[11] 4,184,405

[45] * Jan. 22, 1980

[54] STRINGS FOR MUSICAL INSTRUMENTS

[76] Inventor: James C. How, 20, Upland Rd., Bexleyheath, Kent, England

[ * ] Notice: The portion of the term of this patent subsequent to Jul. 26, 1994, has been disclaimed.

[21] Appl. No.: 803,743

[22] Filed: Jun. 6, 1977

Related U.S. Application Data

[60] Division of Ser. No. 608,802, Aug. 23, 1975, Pat. No. 4,037,506, which is a continuation of Ser. No. 470,286, May 15, 1974, abandoned.

[30] Foreign Application Priority Data

May 20, 1973 [GB] United Kingdom ..... 13182/73

[51] Int. Cl.[2] ..... G10D 3/00

[52] U.S. Cl. ..... 84/297 S; 84/297 R

[58] Field of Search ..... 84/297 S

[56] References Cited

U.S. PATENT DOCUMENTS

| | | | |
|---|---|---|---|
| 2,535,143 | 12/1950 | Kosmis | 84/297 |
| 3,605,544 | 9/1971 | Kondo | 84/199 |

FOREIGN PATENT DOCUMENTS

| | | | |
|---|---|---|---|
| 578743 | 3/1924 | France | 84/297 |

*Primary Examiner*—L. T. Hix
*Assistant Examiner*—S. D. Schreyer
*Attorney, Agent, or Firm*—William A. Drucker

[57] ABSTRACT

A metal string for a fingerboard type stringed musical instrument has a core wire, or wires, and a first part of the length of the string is loaded in known manner while a second part of the length of the string remains non-loaded, the respective lengths of the loaded and non-loaded portions being such that, when the string is fitted to a musical instrument having two string supports such as the conventional "nut" and "bridge", the string may be arranged with the loaded portion supported by the nut and with the non-loaded portion supported by the bridge, but with the vibrating portion between the nut and bridge (the "speaking length" of the string) constituted substantially wholly by loaded string.

2 Claims, 6 Drawing Figures

AMPLITUDE
10
9
8
7
6
5
4
3
2
1
0
55
110
220
330
440
Hz FREQUENCY

AMPLITUDE
10
9
8
7
6
5
4
3
2
1
0
55
110
220
330
440
Hz FREQUENCY

STRINGS FOR MUSICAL INSTRUMENTS

This is a Divisional Application from my co-pending application Ser. No. 608,802 now U.S. Pat. No. 4,037,506, filed Aug. 23, 1975, which was itself a Continuation of my application Ser. No. 470,286 filed May 15, 1974 now abandoned.

This invention relates to metal strings, for fingerboard type musical instruments, having a core wire, or wires, and a winding of one or more loading wires.

Strings for fingerboard type musical instruments are stretched over two supports, and the free span between the supports is referred to as the speaking length, or scale. One support is the "bridge", and the other support is the "nut" or small bridge. Known metal strings for musical instruments are of three types. A first type, known as a "plain string", is usually a single strand, or strands, of wire. The second type, known as a "covered string" has a core wire or wires on which there are applied one or more spiral wrappings of loading wire, the loading extending over the whole length of the string which passes over the supports, so that the whole of the speaking length or scale of the string is loaded. A third type of string, as made for keyboard instruments comprises a core wire or wires with one or more loading windings extending over a continuous portion of the core wire, or wires, but leaving a portion of the core bare, without loading, at each end of the loaded portion, these non-loaded portions at each end passing over the respective supports, and the loaded portion being situated intermediately between and spaced from the supports.

The object of this invention is to provide a loaded string having improved sound and sustained vibration.

According to the present invention, a metal string, for a fingerboard type stringed musical instrument, consists of a wire core including (i) a first portion which extends from one end of said core to a point situated intermediately along said core, (ii) a second portion which extends from said intermediately located point to the other end of the core, said first portion being loaded and said second portion not being loaded.

Preferably, the length of said first portion is at least about the speaking length for which the string is constructed, and advantageously the length of said second portion of the core is not less than 20% of the length of said first portion.

In the case of a guitar, the first loaded potion would be supported by the nut, and the second non-loaded portion would be supported by the bridge. The loaded portion extends to an end of the string, and in a convenient form for commercial purposes the unloaded portion would have sufficient length to pass, with some to spare, over the bridge and to and beyond the usual tailpiece of the instrument to which the unloaded portion of core wire or wires are anchored.

By way of example, for a fingerboard type stringed musical instrument of the kind having a nut and a bridge, a first anchoring means beyond the nut, and a second anchoring means beyond the bridge a metal string of the kind described would be disposed with the loaded portion extending from the first anchoring means over the nut and substantially as far as the bridge, and the non-loaded portion extending over the bridge to the second anchoring means. According to the effect, such as harmonic control, desired by the user, the length of the non-loaded part of the speaking length of the string may be made not greater than 1% and preferably between 0.2% and 0.4% inclusive of the length of the loaded part of the speaking length of the string.

With only the core passing over the bridge, and the loading stopping short of the bridge, there is greater freedom for vibration of the string and it tends to continue vibrating for a longer period than would be the case with a similar core and a similar loading extended along the entire length of the string. Further, the sound produced by the improved string is characteristically different from the conventional loaded string, and includes more harmonics and may be termed a "thinner" sound.

The core may conveniently be a single strand of wire, and the loading may be a single or multiple winding of wire.

An embodiment of musical instrument string, and its application to a fingerboard type stringed musical instrument, are described now with reference to the accompanying drawings, wherein.

Figure 1:
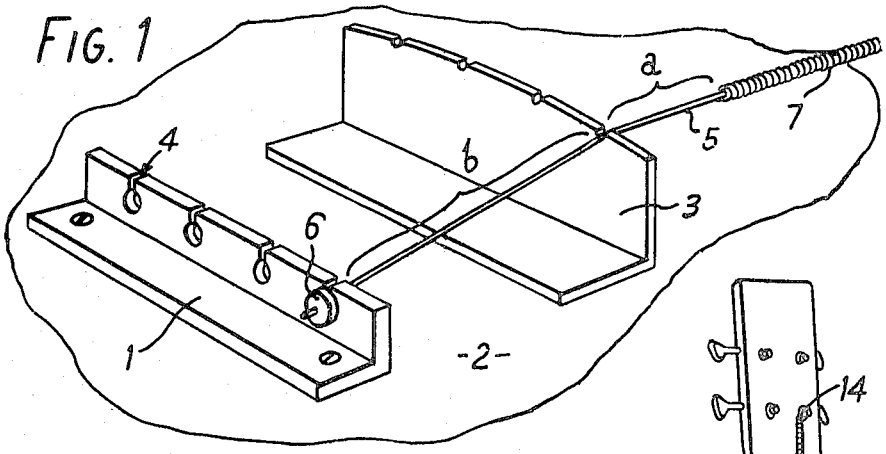
FIG. 1 is a perspective view of a tailpiece and bridge of a representative stringed musical instrument, fitted with the string of the present invention.

A tailpiece 1 is mounted on the body 2 of the instrument at a convenient spacing beyond a bridge 3, and has an aperture 4 to receive each string. A loaded string in accordance with the invention has a core wire 5 which passes over the bridge 3 to the tailpiece 1, to which it is secured by a collar 6 shown in FIG. 2. A loading winding 7 of the string occupies substantially the whole of the speaking length "d" of the string from the nut 12, at the end of the fingerboard 13, say for example 28 to 36 inches in a bass guitar, but stops short of the bridge 3 by a small distance "a", say approximately one-eighth of an inch. Only the core wire 5 is in contact with the bridge 3. The other end of the core is secured in conventional manner to a rotatable peg 14.

The length "b" of the core 5, lying between the bridge 3 and the tailpiece 1, is immaterial and it does not carry any loading 7.

The speaking length of the string can vibrate more freely than when the loading of a conventional string is in contact with and passes over the bridge 3. The vibrations tend to be more sustained and more harmonics are produced in the sound.

Figure 2:
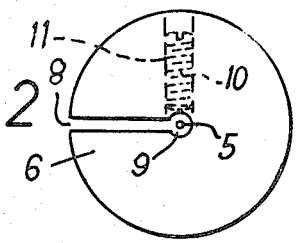
FIG. 2 is an elevation, to a larger scale, of a securing collar for the string.

FIG. 2 shows a collar 6 having a radial slot 8 leading to an axial opening 9 in which the core wire 5 is received. A screw 10 is threaded into a radial bore 11, and can be tightened against the core wire 5 to anchor the collar on the wire.

Figure 3:
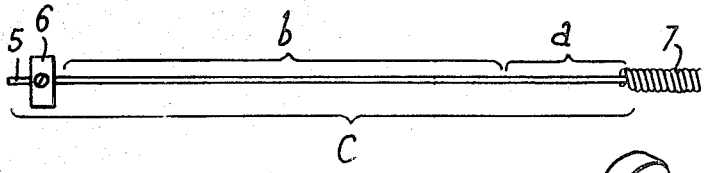
FIG. 3 is an elevation, to a larger scale, of part of the string.

FIG. 3 shows that the total length "c" of the core wire 5 left without any loading winding 7, is somewhat greater than the sum of length "a" to the bridge and length "b" from the bridge to the tailpiece, and it would conveniently be not less than 20% of the length of the loaded portion of the string.

Figure 4:
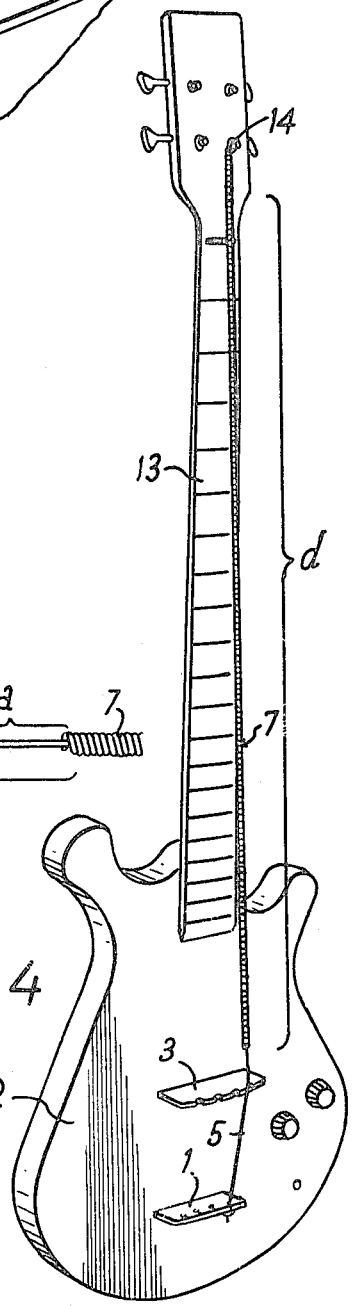
FIG. 4 is a schematic perspective view of a representative fingerboard type stringed musical instrument.

FIG. 4 shows a representative musical instrument equipped with a string in accordance with the invention.

Figure 5:
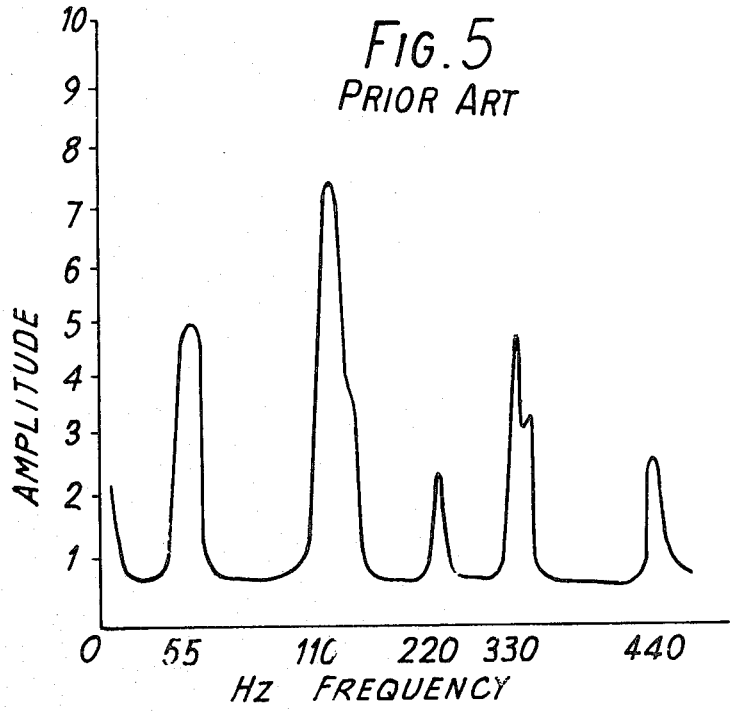
FIG. 5 PRIOR ART
FIGS. 5 and 6 are graphs showing the harmonics and relative amplitudes, respectively for a known commercial string, and for the string of the present invention.

FIG. 5 is a graph showing the fundamental and harmonics, and their relative amplitudes, for a known loaded bass guitar string having the following physical characteristics:

Material, nickel-on-steel music wire
Core wire size—0.020 inches diameter
1st covering wire—0.012 inches diameter
2nd covering wire—0.020 inches diameter
String overall diameter—0.083 inches The string was loaded over its entire vibrating length of 34 inches, i.e. the loaded portion of the string passed over both of the supports.

The graph indicates that the sound produced by the string has a strong content of fundamental frequency, and a very strong second harmonic, and third, fourth and fifth harmonics which are much smaller in amplitude and widely varied in their respective amplitudes.

Figure 6:
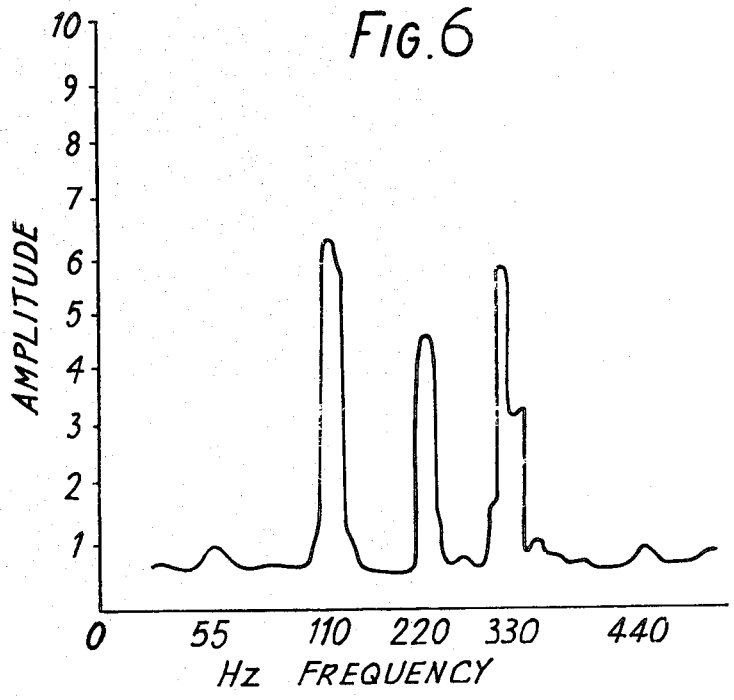

FIG. 6 is a similar graph for the improved string in accordance with the invention. The improved string was made by stripping off the 1st and 2nd covering wires of the string used to produce the graph of FIG. 5, so that the physical characteristics were otherwise identical, and the vibrating length was again 34 inches. The graph indicates that the sound produced by the string has relatively much less content of fundamental frequency, but strong second, third and fourth harmonics which tend much more towards equality in their respective amplitudes. The bandwidth of the harmonics is wide, indicating relatively high energy content giving a full bright sound.

I claim:

1. A metal string, for a fingerboard type stringed musical instrument, consisting of a wire core having a first end and a second end, the entire length of said wire core between its first end and its second end being the sum of (i) a first portion which extends from its first end to a point situated intermediately along the core, the length of that first portion of the core being at least about the speaking length, but less than the total speaking length, for which the string is constructed, said first portion being loaded, and (ii) a second portion which extends from said intermediately located point to said second end of the core, said second portion being wholly devoid of loading.

2. A metal string, as claimed in claim 1, wherein the length of said second portion of the core is not less than 20% of the length of said first portion.

* * * * *